United States Patent [19]

Inoue et al.

[11] 4,187,424

[45] Feb. 5, 1980

[54] RADIOELECTROPHOTOGRAPHY PROCESS

[75] Inventors: Eiichi Inoue, Tokyo; Takashi Yamaguchi, Kanagawa, both of Japan

[73] Assignee: Fuji Photo Film Co., Ltd., Minami-ashigara, Japan

[21] Appl. No.: 797,954

[22] Filed: May 18, 1977

[51] Int. Cl.[2] ..... B41M 5/00

[52] U.S. Cl. ..... 250/315.1; 250/315.2

[58] Field of Search ..... 250/315 R, 315 A

[56] References Cited

U.S. PATENT DOCUMENTS 4,038,545 7/1977 Komaki ..... 250/315 A

*Primary Examiner*—Craig E. Church

*Attorney, Agent, or Firm*—Sughrue, Rothwell, Mion, Zinn and Macpeak

[57] ABSTRACT

A process for radioelectrophotography, which comprises imparting a uniform electrostatic charge to the surface of a recording layer of an image-recording material and containing dispersed therein many cells and/or pores to cause a strong electric charge to act on the gas inside the cells and/or pores, and irradiating the recording layer with radiation carrying image information to imagewise remove the charge on the surface of the recording layer and form an electrostatic latent image.

9 Claims, 17 Drawing Figures

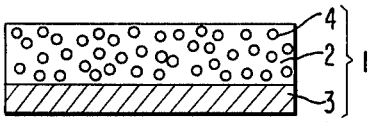
FIG. 1a
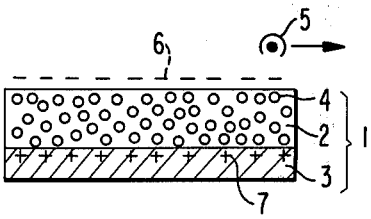
FIG. 1b
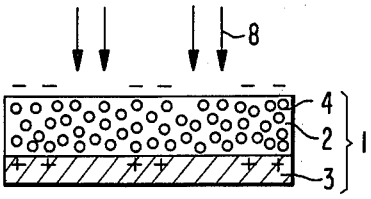
FIG. 1c
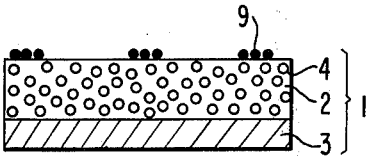
FIG. 1d
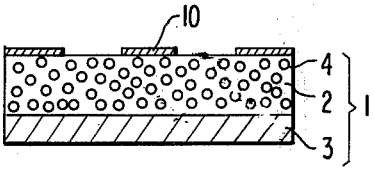
FIG. 1e
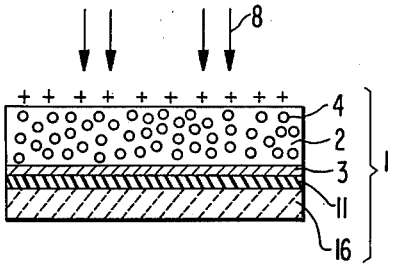
FIG. 3
FIG. 4a
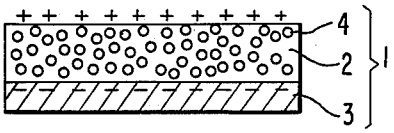
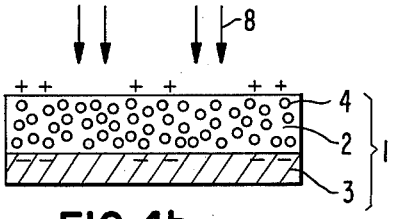
FIG. 4b
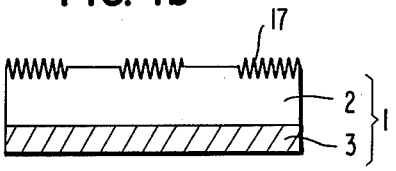
FIG. 4c

RADIOELECTROPHOTOGRAPHY PROCESS

BACKGROUND OF THE INVENTION

1. Field of the Invention

The present invention relates to radioelectrophotography process for recording image information carried by radiation.

2. Description of the Prior Art

As one process for recording radiation images, there is a process called "xeroradiography" which uses light-sensitive materials for electrophotography, in addition to the ordinarily employed processes using silver halide photographic light-sensitive materials.

As one example of a xeroradiographic process, there is the process employing xerography and irradiating with X-rays instead of visible light to obtain a latent image comprising an electric charge distributions of X-ray-irradiated areas and non-irradiated areas, as described in U.S. Pat. No. 2,666,144.

As another example of a xeroradiographic process, there is the process utilizing a fluorescent substance or the like as an auxiliary substance in the above-described process in order to supplement the weak radiation absorption efficiency of the light-sensitive layer, and irradiating an electrophotographic light-sensitive material with radiation and the visible light emitted by the fluorescent substance as described in U.S. Pat. No. 2,856,535.

Final images are formed by subjecting the latent images obtained by the above processes to toner development or by transferring the thus formed toner images to a resin plate or the like, or by conducting toner development after transferring the latent images to a resin plate or the like.

However, as compared with the sensitivity of silver halide materials, the sensitivity of radioelectrophotographic materials used in such processes is so low that they are employed with difficulty except in certain radiophotographic procedures (e.g., "mammography").

On the other hand, as one radioelectrophotographic process providing high sensitivity, there is the process described by Reiss (hereinafter referred to as the "Reiss chamber process") in *Zeitschrift für Angevandte Phiski*, vol. 19, ppl-4 (Feb. 19, 1965) which comprises using as one electrode a metal plate capable of emitting electrons upon irradiation and as another electrode a metal plate, and irradiating an insulating film inserted in the gap between the electrodes while applying a high voltage across the electrodes, thereby forming latent images on the insulating film surface.

In this process, electrons emitted by radiation ionize gas during traveling between the electrodes to remarkably increase the number of electric charges, and the electrons thus increased in number attach to the insulating film to form a latent image. Therefore, there can be expected higher sensitivity as compared with the aforesaid xeroradiography. However, changes in the distance of the gap between the electrodes across which the voltage is applied cause great changes in the electron-amplifying ratio (i.e., sensitivity), the gap between the electrodes must be maintained narrow, and, in addition, the gap must be maintained constant, at least in the area greater than image area to be formed. This process is difficult to practice.

A process analogous to the above-described Reiss chamber process is the process described in Japanese Patent Application (OPI) No. 82,791/73 (hereinafter referred to as the "Xonics process"). This process comprises using an ordinary metal electrode in place of a metal electrode capable of emitting electrons as is employed in the Reiss chamber process, irradiating to directly discharge in the gas between electrodes, and adhering generated ions onto an insulating film to form a latent image.

In this process, a gas of a higher atomic nubmer such as Xe, Kr, etc., is held in the gap between the metal electrodes at atmospheric pressure or above to improve the efficiency of radiation absorption, and the generated ions are adhered to an insulating film. Therefore, similarly with the aforesaid Reiss chamber process, there can be expected higher sensitivity as compared with xeroradiography. However, to maintain the gap distance between the electrodes is technically difficult, and, in addition, it is difficult to maintain the electrodes parallel since the gap is held at atmospheric pressure or above (at least the electrode on the side struck with X-rays is liable to undergo bending or the like since its thickness must be thin in order to minimize the absorption of X-rays) and, in addition, there is the problem of introducing the gas into the gap between the electrodes and the problem of the gas-discharging means. Thus, this process lacks practical utility. When the pressure of the gas is increased to raise the sensitivity, these defects become greater.

SUMMARY OF THE INVENTION

We have discovered that after imparting a uniform electrostatic charge to a recording layer containing dispersed therein many cells or pores to thereby form an extremely strong electric field (about 30,000 to about 1,500,000 volt/cm) acting on the gas inside the cells or pores, removal of charge or decay of the voltage on the surface can be conducted with high efficiency by irradiating the recording layer with radiation. This phenomenon may be attributed to the fact that since an extremely strong electric field acts on the gas inside the cells or pores in the recording layer, the action of breeding charged particles of gas ions generated by the irradiation occurs with super-high efficiency, which causes a removal or surface potential decay on the recording layer with high efficiency.

That is, the present invention relates to process of radioelectrophotography, which comprises imparting a uniform charge on the surface of a recording layer containing dispersed therein many cells and/or pores to thereby act a strong electric field on the gas inside the cells or pores, and irradiating the recording layer with radiation carrying image information to remove the charge or decay electric potential on the recording layer, thus forming an electrostatic latent image.

BRIEF DESCRIPTION OF THE DRAWINGS

FIGS. 1*a* to 1*e* are schematic cross sectional views showing the steps of a typical process of the present invention.

FIGS. 3 and 4 are cross sectional views showing other examples of recording materials of the present invention.

Figure 2A:
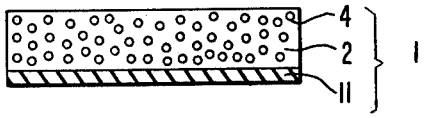
FIGS. 2*a* to 2*h* are cross sectional views showing an example of a recording material used in the present invention.

In the Figures, numeral 1 designates a recording material, 2 a recording layer, 3 a conductive support, 4 cells and 13 pores.

DETAILED DESCRIPTION OF THE INVENTION

A typical recording process of the present invention will be described by referring to the drawings.

FIG. 1 comprises schematic views showing each step in a typical recording process of the present invention, wherein (a) shows a recording material, (b) a charging step, (c) an irradiation step, (d) a developing step, and (e) a final image. That is, a recording material 1 comprising a conductive support 3 having provided thereon recording layer 2 of insulating or photoconductive material containing many cells 4 as shown in (a) is charged as shown in (b) by imparting an electrostatic charge on the surface of the recording layer 2 using a corona charging apparatus 5. An extremely strong electric field (about 30,000 volt/cm or more) is acted on the gas inside cells 4 in recording layer 2 by this charging. Numeral 6 designates charges imparted to the surface of the recording layer 2, and 7 designates opposite charges induced inside the conductive support 3.

This recording material 1 is then imagewise irradiated with radiation as shown by arrows 8 in step (c) (X-ray intensity: tube voltage of 70 KVp; X-ray amount: about 1.1 mR to 15 mR). Since gas in cells 4 is under a strong electric field from the foregoing step, radiation struck gas is strongly ionized and breeding ionization results, whereby, a large amount of charged bodies are produced. As a result, the electric resistance of the gas is reduced so much that charges on the surface of the recording layer 2 disappear to form an electrostatic latent image on the surface of recording layer 2.

Thereafter, the thus formed latent image is developed and fixed by a developing process as is employed in conventional electrophotography, as is shown in (d) and (e). Numeral 9 designates the formed toner images and 10 the fixed toner images.

As is described above, the present invention provides the extremely remarkable effect that, in highly sensitive radioelectrophotography involving breeding ionization, this invention eliminates the need for using metal electrodes which must be uniformly parallel, which has been a technical problem in the prior art such as the Reiss chamber process and the Xonics process.

A specific example of the present invention will be illustrated below.

Image-recording material

Figure 2B:
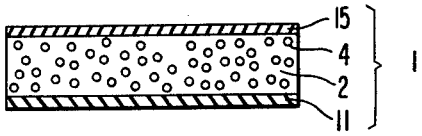
Figure 2C:
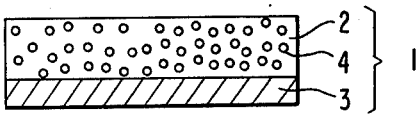
Figure 2D:
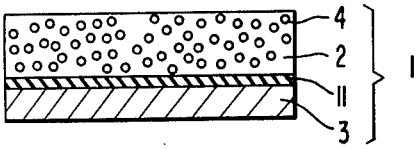
Figure 2E:
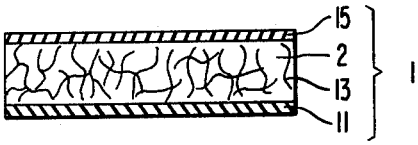
Figure 2F:
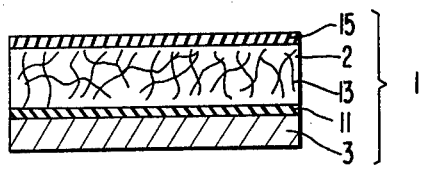
Figure 2G:
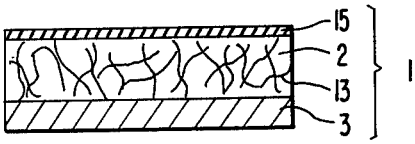
Figure 2H:
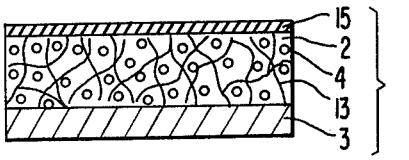

Specific examples of image-recording materials used in the present invention are shown in FIG. 2; the following materials can be used as such image-recording materials, wherein the following description is given according to the nomenclature (a)–(h) in FIG. 2.

(a) This comprises an insulating support 11 having provided thereon recording layer 2 of an insulating or photoconductive thin film containing many pores or cells 4 or both. In image formation, this is used by intimately adhering the same to a conductive base plate. A suitable range for the volume resistivity of the insulating layer is at least about $10^9\Omega$cm. The dark resistance of the photoconductive layer is at least about $10^9\Omega$cm and the light resistance is about $10^9\Omega$cm or less. A suitable thickness of the photoconductive thin layer can range from about 1 $\mu$m to 50 $\mu$m.

(b) This comprises recording material 1 shown in (a) further having provided on recording layer 2 an insulating or photoconductive thin layer 15.

(c) This comprises conductive support 3 having provided thereon recording layer 2 of recording material 1 shown in (a).

(d) This comprises the recording material shown in (c) having provided between recording layer 2 and conductive support 3 insulating or photoconductive thin layer 11.

(e) This comprises recording layer 2 of an insulating or photoconductive thin film containing many pores 13 having an aerating property sandwiched between insulating or photoconductive thin film 11 and 15 having the identity as above defined for individual layers 11 and 15. Upon image formation, this is used by intimately adhering the same to a conductive base plate.

(f) This comprises conductive support 3 having provided thereon recording material 1 as shown in (e).

(g) This is prepared by replacing one of the sandwiching layers in recording material 1 in (e) by conductive support 3.

(h) This contains as recording layer 2 a layer containing both cells 4 and pores 13.

Recording layer

The size of cells in recording layer 2 in the above recording materials (a) to (d) is usually within the range of from about 0.0025 $\mu$m to about 100 $\mu$m, preferably 0.1 to 100$\mu$ in diameter, and the cells are desirably almost uniform in size, though such is not limitative. A suitable degree of porosity of the recording layer can range from about 21 to about 85 vol %. The density of the cells in the recording layer is desirably high so long as the necessary strength is maintained. Also, the size and the density of the pores in (e) to (h) may be the same as the size and the density of the cells in (a) to (d). The gas pressure in the cells generally is about 1 atmosphere and generally the gas present in the cells is air.

The thickness of the recording layer is not parcicularly limited, but usually is about 0.5$\mu$ to about 1 mm. The film thickness is decided based on the magnitude of desired surface charge. The mechanical strength of the recording layer may sufficiently be about the same as that of ordinary photographic materials or electrophotographic light-sensitive materials.

Recording layer-forming material

As the material for forming the recording layer containing cells or pores or both, organic or inorganic substances or a mixture thereof having specific resistance of at least $10^9$ ohm-cm or more is used.

Organic substances

As the organic substance, natural or synthetic high molecular weight polymer materials can be freely used in the recording layer having structures (a)–(d) and (h) as shown in FIG. 2.

As the natural high molecular weight polymer materials, gelatin, casein, rosin, rubber, glue, cellulose derivatives, starch, etc., are useful.

As synthetic high molecular weight polymer materials, almost all film-forming polymers can be used the only condition being the ability to form pores or cells therein. Many examples are enumerated below be classifying the same into groups.

Thermoplastic, water-insoluble resins

Polyvinyl alcohol, polyvinyl acetate, polystyrene, polyvinyl chloride, polyvinylidene chloride, polyvinylidene chloro-butylchloride, polyacrylic esters, polymethacrylic esters, polymethacrylic esters, polyacrylamide, polyacrylonitrile, polyvinyl pyrrolidone, polyethylene oxide, polymethylolacrylamide, polymethacrylonitrile, polyvinyl butyrate, polybutadiene, polyacrylic acid, polyacrylamide, polyalkylacrylamide, copolymers of acrylonitrile and one of vinyl chloride, styrene, vinylidene chlorofluoride, 1,1-difluoro-ethylene, etc., copolymers of vinyl chloride and one of methacrylate, acrylic acid, diethyl maleate, vinyl acetate, etc., copolymers of vinylidene chloride and one of vinyl chloride, vinyl acetate, vinyl alcohol, methyl acrylate, acrylonitrile, etc., are useful.

Thermosetting resins

Alkyd resins, unsaturated polyester resins, epoxy resins, phenol resins, urea resins, melamine resins, xylene resins, toluene resins, guanamine resins, etc., are useful.

Water-soluble resins

Polyvinyl alcohol, polyacrylamide, polyacrylic acid, polymethacrylic acid, polyvinyl pyrrolidone, gelatin, starch, (water-soluble) glue, polyethylene oxide, polymethylolacrylamide, etc., are useful.

Photoconductive polymers

Aromatic vinyl polymers (e.g., polyacenaphthylene, polyvinyl anthracene, etc.) nitrogen-containing hetero acid vinyl polymers, polyvinyl carbazole, etc., are useful.

Systems rendered photoconductive by adding a photoconductive substance to conventional polymer Combinations of polystyrene, polycarbonate, silicone resins, phenoxy resins, phenol resins, epoxy resins, polyurethanes or the like with a Lewis acid, a dye (e.g., a pyrylium salt, triarylmethane, merocyanine, cyanine, etc.), etc., and materials forming a CT complex prepared by adding an electron donating compound such as triphenylamine and an electron receiving compound such as tetracyanoquinodimethane are useful. A suitable amount of the photoconductive material added can be up to about 100% by weight to the polymer, generally up to about 15% by weight to the polymer.

Also, in the recording layer having structures (e) to (g) as shown in FIG. 2, all organic substances which can be pulverized into a powder can be used in addition to the aforesaid high polymer materials.

Inorganic substances

As inorganic substances, glass-forming materials are useful for a recording layer having structures (a) to (d) or (h) as shown in FIG. 2, and there can be used conventional glasses such as silicate glasses, chalcogenide glasses, alkali silicate glasses, soda lime glasses, potash lime glasses, alkali glasses, barium glasses, borosilicate glasses, selenium-deposited inorganic polymer, and the like.

In addition, in the recording layer having structures (e) or (g) as shown in FIG. 2, the inorganic substances are not limited to the above-described glass-forming materials, but all substances that are non-conductive inorganic substances capable of being solidified and forming pores are useful.

In the case of using such as inorganic substance powder, it is possible to form the recording layer by using a suitable adhesive, and it is also possible to use an organic material and an inorganic material in combination. As such inorganic substances, there can be illustrated metal oxides, metal halides, metal sulfides, etc., and any one that forms a stable powder or film can be used. Further, there can be utilized those which are prepared by kneading Pb, Sn or a like heavy metal powder into the material for making the pore/cell containing layer or by mixing Br, I or the like, e.g., in an amount of 50 weight % or less in order to raise the X-ray absorption of the recording layer. In this case, these inorganic substances may be in the colored state, if desired.

Further, as inorganic photoconductive substances, there can be illustrated zinc oxide, zinc sulfide, cadmium sulfide, titanium oxide, non-crystalline selenium and alloys thereof with arsenic or tellurium. U.S. Pat. No. 3,121,006 describes many inorganic photoconductors, all of which are useful.

This layer of material supporting or covering the recording layer

Any of the insulating or photoconductive materials forming the recording layer can be used.

Material for the conductive support

The conductive support may be freely selected from those conventionally used for electrophotography, and any substance that possesses a resistance of about $10^8$ ohm/□ or less can be used. For example, there can be used aluminum, copper, silver, gold or a like metal or an alloy thereof, supports prepared by providing a thin film of aluminum, palladium, copper, silver, gold or the like or a tin oxide film on a glass or resin film, etc., and paper processed to make it electroconductive. As conductivity-imparting agents for paper, agents used in the field of electrophotography can be utilized, for example, polyvinyl benzyl, trimethylammonium chloride, poly(N,N-dimethyl-3,5-methylenepiperidinium chloride), polyvinylbenzenesulfonic acid sodium salt, colloidal alumina, etc. are particularly useful.

Further, materials prepared by solidifying a powder of aforesaid metal or alloy with a resin can be used. Rectifying property desirably does not exist between the recording layer and the conductive support or conductive base, though the existence thereof does not prevent the use of the same.

Process for preparing recording material

[A] Cell-containing recording layer (a) Cell formation of gas molecules generated by photolysis of a recording layer-constituting substance.

As the binder, there can be used polyvinyl chloride, polyvinylidene chloride, polystyrene, copolymers of acrylonitrile and vinyl chloride, styrene, vinylidene chlorofluoride, or 1,1-difluoroethylene, copolymers of vinyl chloride and methyl acrylate, acrylic acid, diethyl maleate or vinyl acetate. Another group of suitable binders consists of copolymers of vinylidene chloride and vinyl chloride, vinyl acetate, vinyl alcohol or ethyl acrylate. The rigidity, gas-diffusing property and permeability of thermoplastic resins can be adjusted by adding additives thereto, if desired. For example, methyl polymethacrylate (Acryloid A-101) can be added to adjust the properties of a copolymer of vinylidene chloride and acrylonitrile (Saran F-120).

After dissolving these binders in a suitable solvent, it is mixed with the following light-sensitive substance and, after coating the mixture on a support, uniformly exposed to form a recording material having a recording layer containing cells.

As the light-sensitive materials, diazo compounds of the benzene and naphthalene series are typically used.

Particularly valuable ones are p-diazodimethylaniline and p-diazodiethylaniline (both being $ZnCl_2$ complex salts), p-diazodiphenylamine sulfate, p-diazoethylhydroxyethylaniline ($ZnCl_2$ complex salt), 1-diazo-2-hydroxy-naphthalene-4-sulfonate, 4-benzoylamino-2,5-diethoxybenzenediazonium chloride and 4-diazo-2-methoxy-1-cyclohexylaminobenzene p-chlorobenzenesulfonate. 7-Dimethylamino-8-methoxy-3-oxo-dihydro-1,4-thiazine-6-diazonium chloride and analogous compounds are also suitable. 1-Dimethylamino-4-naphthalenediazonium fluoroborate, 3-oxo-7-dialkylaminobenzothiazinediazonium borofluoride can also be used.

As other compounds used for forming cell images by exposure and thermal development, there are 1-carbazido-2,5-dihydroxybenzene, 2-amino-1-carbazidobenzene, 2-carbazido-1-naphthol and 1,4-dicarbazido-2,3-dihydroxyfuran. Further, 3- or 4-azidophthalic anhydride can be used. All of these compounds possess an azido group ($-N_3$) in their molecule, which is decomposed upon exposure to generate nitrogen gas. There can also be used diazoxide, diazosulfonate, diazoquinonylsulfonamide, azide and quinondiazide, in particular, sodium 1,2-naphthoquinone-2-diazide-5-sulfonate.

Cell images can also be formed by the photolysis product of ammonium iron (II) citrate or the photodepolymerization of a polyketone such as a 2,4-dimethyl-1-pentene-3-one polymer. Films to which light sensitivity is imparted using the latter compound are different from films to which light sensitivity is imparted using diazo compound. With the forner, one photon generates many monomers, which are used to form cells, whereas, with the latter using diazo compounds, many photons are required per 1 cell. Another substance for use in the cell-forming process comprises a layer of compound which releases a hydrogen halide upon being exposed to active light. As suitable compounds, there are polyvinyl chloride, polyvinylidene chloride, chlorinated paraffins or rubbers, N-bromosuccinimide, etc. A second component in a light-sensitive layer is an alkali or alkaline earth metal carbonate, bicarbonate, oxalate, or tartrate, which generates gas together with hydrogen halide.

As a further compound used for forming cells, there is ferric oxalate. This compound generates carbon dioxide gas as a photolysis product, which forms cells in a recording layer.

$$Fe_2(C_2O_4)_3 \xrightarrow{h\nu} 2Fe(C_2O_4) + 2CO_2 \uparrow$$

(b) Cell formation of gas generated by thermal decomposition of a recording layer substance.

Any of the above-described materials that can generate gas upon photolysis can be used. Further, materials which generate oxygen upon thermal decomposition such as oxides and materials which generate $CO_2$ upon thermal decomposition, such as oxalates and forming polyurethane can be used.

(c) A process of dissolving out a soluble material contained in a recording layer material with water or a solvent to form cells, and, after dissolving out, sealing the gas therein by heating (in this case, both cells and pores are formed).

(d) A microcapsule layer is used as a recording layer.

[B] Pore-containing recording layer (a) Processes of making many fine pores in a recording layer material, Electric discharge-working process, Mechanical or chemical process, Dissolving-out process.

(b) A process of binding a fine powder with a resin binder and coating or blowing the mixture.

(c) A process of massing glass fibers or the like by suitable means into a layer state and laminating it with a film. In this case, a cover layer, a sandwiching layer or the like are formed by blowing, coating, vacuum evaporation, melt spraying or the like. It is particularly effective to form this layer by film lamination since the desired gas is sealed in the pores.

The kind of gas of gases in the cells or pores is not limited, but usually nitrogen, a halogen, oxygen, carbon dioxide gas, CO, a rare gas, or the mixture there of (for example air) is used. It is particularly effective to use gases having a high inoezing. efficiency such as gases having atomic number of 36 or above (e.g., Xe, Kr, etc.).

Charging process

As the charging process, any of those employed in electrophotography such as a corona charging, a frictional charging, an electrode-contact process, or the like can be used. The charging amount varies depending upon the developing step to be described hereinafter, the thickness of the recording layer and the like, but about 50 V to about 1500 V (as surface potential) is usually employed.

Developing process

As the developing process, a cascade developing process as described in U.S. Pat. No. 2,618,551, a magnetic brush developing process as described in U.S. Pat. No. 2,786,439, a powder cloud developing process and an open chamber process as described in U.S. Pat. Nos. 2,691,345 and 2,725,304, a Magnedry developing process (trade name) as described in German patent application (OLS) No. 2,313,297, an ink mist process and a liquid developing process as described in U.S. Pat. Nos. 2,877,133 and 2,907,674 are effective.

Further, when using a latent image as shown in FIG. 1 (c), development may be conducted after transferring the latent image to, for example, a transparent or opaque film or paper according to the electrostatic image-transferring (TESI) process. Needless to say, toner image 9 as shown in FIG. 1 (d) may be transferred to another support such as a transparent or opaque film, paper, metal or the like, if desired.

Fixing process

Any process conventionally employed in electrophotography, such as a thermal fixing process, a solvent fixing process, a pressure fixing process, or the like can be employed. In particular, it is possible to remove cells or pores in recording layer 2 upon fixing recording material 1 as shown in FIG. 1 (*d*) utilizing thermal fixing.

Radiation

As the radiation used, X-ray are typical. However, any radiation that can ionize the gas in the cells or pores of the recording layer such as extremely ultraviolet rays, gamma rays, alpha rays, or the like can be used.

One embodiment of further increasing the sensitivity in the radioelectrophotographic process of the present invention is shown in FIG. 3. FIG. 3 shows a material wherein a fluorescent-sensitizing layer 16 as is used for silver salt X-ray photography is combined, via insulating thin layer 11, with recording material 1 as shown in FIG. 2. In this case, a photoconductive material is used for the recording layer 2. Processing this material must be conducted in the dark, but is fundamentally the same as with that shown in FIG. 1.

When irradiation with radiation is conducted after charging the surface of the recording layer 2 of recording material 1, charged particles are formed by radiation in the gas inside the cells or pores and the charge is reduced by migration thereof and, in addition, the surface charge-decaying effect is further raised by the photoconductive phenomenon of the recording layer due to the ultraviolet rays or visible light generated by the radiation reaching the fluorescent-sensitizing layer 15. However, this fluorescent-sensitizing effect is small as compared with the charge-decaying action due to the charged particle-forming mechanism in the gas inside the cells or pores, and performs only an auxiliary action in this system. In this embodiment, insulating thin layer 11 is not necessarily required.

Further, as is shown in FIG. 4, a process of removing cells or pores and at the same time forming a frost image 17 on the surface by heating the recording layer is also effective as a process for rendering the electrostatic images visible. In this process, thermoplastic resins must be used as the material for recording layer 2 having cells or pores. Another merit of this process is that cells or pores in recording layer 2 can be removed by heating upon the formation of the frost image.

In the present invention, the recording layer, conductive support, insulating thin layer and the like are desirably transparent, but opaque ones may also be used. In particular, when formed toner images are to be transferred to another support, the recording materials may be opaque. Further, these layers may be colored any desired color, because, for example, when these materials are colored black and development is conducted using, for example, a white toner, negative-positive images can be obtained by development in the positive-positive mode, or contrast can be improved by using a recording material and toner having different colors from each other.

In the above, description has been given for the case of negatively charging the surface of the recording layer. However, this polarity may be positive or negative, and, when rectifying property exists between the recording layer 2 and the conductive support, it is preferable to select a polarity effective for removing the surface charge. In such case, too, it is not particular problem to conduct charging reverse in polarity.

Needless to say, although only normal development wherein toner adheres to areas having charge has been illustrated, a reverse development wherein toner adheres to charge-free areas is also useful.

EXAMPLE 1

A light-sensitive emulsion prepared by dispersing p-diazodimethylaniline in polyvinylidene chloride binder was coated on one side of a 100$\mu$ thick polyethylene terephthalate film (hereinafter PET), the vacuum evaporated metal layer thereon (trade name: Toray Hi Beam) made by Toray Industries, Inc., and uniformly exposed (200 mW/sec.cm$^2$ (3850 Å) and heated (110° F. to 160° F.) in a short time to form a recording layer having uniform cells, which was used as a recording material. The thickness of the layer containing cells was 20$\mu$.

The conductive layer of this recording material was grounded, and the recording layer surface charged to −600 V using a corona charging apparatus. Then, X-rays were irradiated thereon under the conditions; 70 kV X-ray source voltage, 4 mA tube electric current; 40 cm distance between the X-ray source and the recording material; 1 second in irradiation time. The surface potential of the recording layer was reduced to about 10% or less than that.

EXAMPLE 2

Microcapsules about 100$\mu$ in diameter containing Ar gas (about 1 atm) was scattered on an aluminum base plate in a thickness of about 0.5 mm, and fixed with an insulating binder of a layer thickness of about 1 to 2 $\mu$m, the resulting material being used as a recording material.

The microcapsule-coated surface (recording layer surface) of the recording material was charged to about 6000 V. When X-rays were irradiated under the conditions; 70 kV X-ray source voltage; 40 cm distance between the X-ray source and the recording material, the surface potential of the recording layer fell to almost zero at 4 mA.sec tube electric current.

EXAMPLE 3

Silica powder (particle size of about 1 to 2 $\mu$m or less) was solidified in plate form of about 1 mm in thickness, and about a 5$\mu$ thick vinylidene chloride resin film was adhered to both sides of the silica plate. Colloidal silica was then coated on one side to impart conductivity thereto, and the resulting material used as a recording material.

The non-conductive side of this recording material was charged to about 10 kV. When X-rays were irradiated under the conditions; 100 kV X-ray source voltage and 40 cm distance between the X-ray source and the recording material, the surface electric potential was decayed to 30% of its original value at 6 mA.sec.

EXAMPLE 4

In the same process as in Example 3, a 0.7 mm-thick copper phthalocyanine pigment layer was prepared, and one side was laminated to about a 6$\mu$ thick PET film, and the other side with a 6$\mu$ thick PET film having one conductive side (facing the conductive side). Further, a fluorescent-sensitizing body (such as $BaSO_4$:Pb, ZnS:Ag, $Gd_2O_2$Tb, $Y_2O_2$S:Tb, $CaWO_4$ etc.) used for conventional X-ray photography was intimately adhered thereto to prepare a recording material to be used.

When charging and X-ray irradiation were conducted on the PET side of this recording material in the same manner as in Example 3, the surface electric potential fell to zero at 6 mA.sec.

While the invention has been described in detail and with reference to specific embodiments thereof, it will be apparent to one skilled in the art that various changes and modifications can be made therein without departing from the spirit and scope thereof.

What is claimed is:

1. A process for radioelectrophotography, which comprises imparting a uniform electrostatic charge to the surface of a recording layer of an image-recording material containing dispersed therein many cells and/or pores with gas sealed therein so as to cause a sufficiently strong electric charge to act on the gas inside said cells and/or pores to substantially ionize said gas, and irradiating said recording layer with penetrating radiation carrying image information to imagewise remove the charge on the surface of said recording layer and form an electrostatic latent image, wherein the gas is selected from the group consisting of air, nitrogen, a halogen, oxygen, carbon dioxide, carbon monoxide, a rare gas, and mixtures thereof the size of said cells in said recording layer ranges from about 0.0025 mμ to about 100 mμ and the degree of porosity of said recording layer ranges from about 27 to about 85 volume %.

2. The process of claim 1, wherein said image-recording material comprises an electrically insulating support having thereon said recording layer and said recording layer comprises an insulating photoconductive thin film containing many cells.

3. The process of claim 2, wherein said image-recording material contains additionally an electrically insulating or photoconductive thin layer on said recording layer.

4. The process of claim 1, wherein said image-recording material comprises an electrically conductive support having thereon said recording layer and said recording layer comprises an insulating or photoconductive thin film containing many cells.

5. The process of claim 4, wherein said image-recording material additionally contains an electrically insulating or photoconductive thin layer between said recording layer and said electrically conductive support.

6. The process of claim 1, wherein said image-recording material comprises an electrically conductive support having thereon said recording layer sandwiched between electrically insulating or photoconductive thin films with said recording layer comprising an electrically insulating or photoconductive thin film containing many pores.

7. The process of claim 1, wherein said image-recording material comprises an electrically conductive support having thereon said recording layer and said recording layer comprises an insulating or photoconductive thin film containing many cells and/or pores with an insulating or photoconductive thin film thereon.

8. The process of claim 1, wherein said recording layer comprises a layer of an organic or inorganic material or mixture thereof having said many cells and/or pores dispersed therein and a specific resistance of at least about $10^9$ ohm-cm or higher.

9. The process of claim 1, wherein the thickness of said recording layer ranges from about 0.5μ to about 1 mm.

* * * * *